US006191930B1

(12) United States Patent
Ramchandani

(10) Patent No.: US 6,191,930 B1
(45) Date of Patent: Feb. 20, 2001

(54) IONIZING HAIR DRYER

(75) Inventor: Prem A. Ramchandani, New York, NY (US)

(73) Assignee: IGIA Direct, Inc., New York, NY (US)

( * ) Notice: Under 35 U.S.C. 154(b), the term of this patent shall be extended for 0 days.

(21) Appl. No.: 09/378,266

(22) Filed: Aug. 20, 1999

(51) Int. Cl.[7] ..... H05F 3/06
(52) U.S. Cl. ..... 361/213; 392/380
(58) Field of Search ..... 361/212, 213, 361/220, 221, 222, 235; 392/380, 383, 385

(56) References Cited

U.S. PATENT DOCUMENTS 4,258,408 3/1981 Cantelli ..... 361/213
5,612,849 3/1997 Prehodka et al. ..... 361/213
5,805,406 9/1998 Mailand ..... 361/212

FOREIGN PATENT DOCUMENTS 2067071 7/1981 (GB) ..... A45D/20/00

*Primary Examiner*—Ronald W. Leja
(74) *Attorney, Agent, or Firm*—Helfgott & Karas, P.C.

(57) ABSTRACT

A hair dryer is provided with a high voltage generator which produces a negative DC voltage output of at least about 6 kilovolts for reducing static charges on a person's hair during hair drying. The generator can be mounted adjacent the dryer air inlet of the hair dryer housing to cool the generator with cooling air, or the generator can be mounted externally of the dryer to reduce dryer weight.

12 Claims, 3 Drawing Sheets

IONIZING HAIR DRYER

BACKGROUND OF THE INVENTION

1. Field of the Invention

The present invention relates in general to hot-air hair dryers and relates particularly to a hot-air hair dryer which produces negative ions using a high-voltage transformer.

2. Description of Prior Developments

It is well known that combing and brushing one's hair can impart a static electrical charge on the hair. This is generally considered undesirable insofar as statically charged hair is difficult to manage and can attract airborne dust and dirt.

Since one's hair is often brushed or combed when being dried by a conventional hair dryer, some hair dryers have been provided with ion generators to neutralize the static charge created by combing and brushing during hair drying. Although these prior hair dryers generally function satisfactorily, they often rely on the use of piezoelectric generators to produce ions. These generators must be mechanically operated by a user and are not particularly convenient to use.

Some prior ion-generating hair dryers have used voltage generators to produce ions, but the voltages produced have been relatively low, such as 1600 to 1700 volts applied to a negative ion emitter. Moreover, conventional voltage generators are relatively bulky and heavy and result in a relatively large hair dryer assembly.

Accordingly, a need exists for an ion-emitting hair dryer which produces relatively highly charged negative ions and which requires a single ion generator.

A further need exists for such a hair dryer which is compact, lightweight, easy-to-use and which avoids the use of manually-actuated piezoelectric ion generators.

SUMMARY OF THE INVENTION

The present invention has been developed to fulfill the needs noted above, and therefore has as an object the provision of a hair dryer which emits highly charged negative ions for neutralizing the static charge on hair as it is being brushed or combed and dried.

A further object of the invention is the provision of an ion-emitting hair dryer which uses a high-voltage transformer to produce highly charged negative ions.

Another object of the invention is to provide a hair dryer having a high-voltage transformer located in the ambient air intake flow path of the dryer.

Yet another object of the invention is the provision of an ion-emitting hair dryer having a high-voltage transformer located on the exterior of the hair dryer.

These and other objects are met by the present invention which is directed to an ion-emitting hair dryer having a transformer which produces a negative electrical charge of at least about 6000 volts. This relatively high negative voltage significantly improves the manageability of ionized or statically-charged hair. A negative ion-generating electrode can be located in a conventional manner near the outlet of the hair dryer or at a position between the fan and the heating coil of the hair dryer.

The transformer can be advantageously located at the intake side of the dryer fan to receive cooling intake air, or the transformer can be located on the exterior of the hair dryer, such as on the power cord. In this latter case, the elimination of the transformer from the body of the hair dryer significantly reduces the weight of the hair dryer and thereby increases its ease of use.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawings, like reference characters designate like parts.

DETAILED DESCRIPTION OF THE PREFERRED EMBODIMENTS

The present invention will now be described in conjunction with the drawings, beginning with FIGS. 1 and 2 which show a negative-ion-emitting hair dryer 10 constructed in accordance with the invention. The dryer includes a hollow handle 12 connected to a tubular housing 14.

Figure 2:
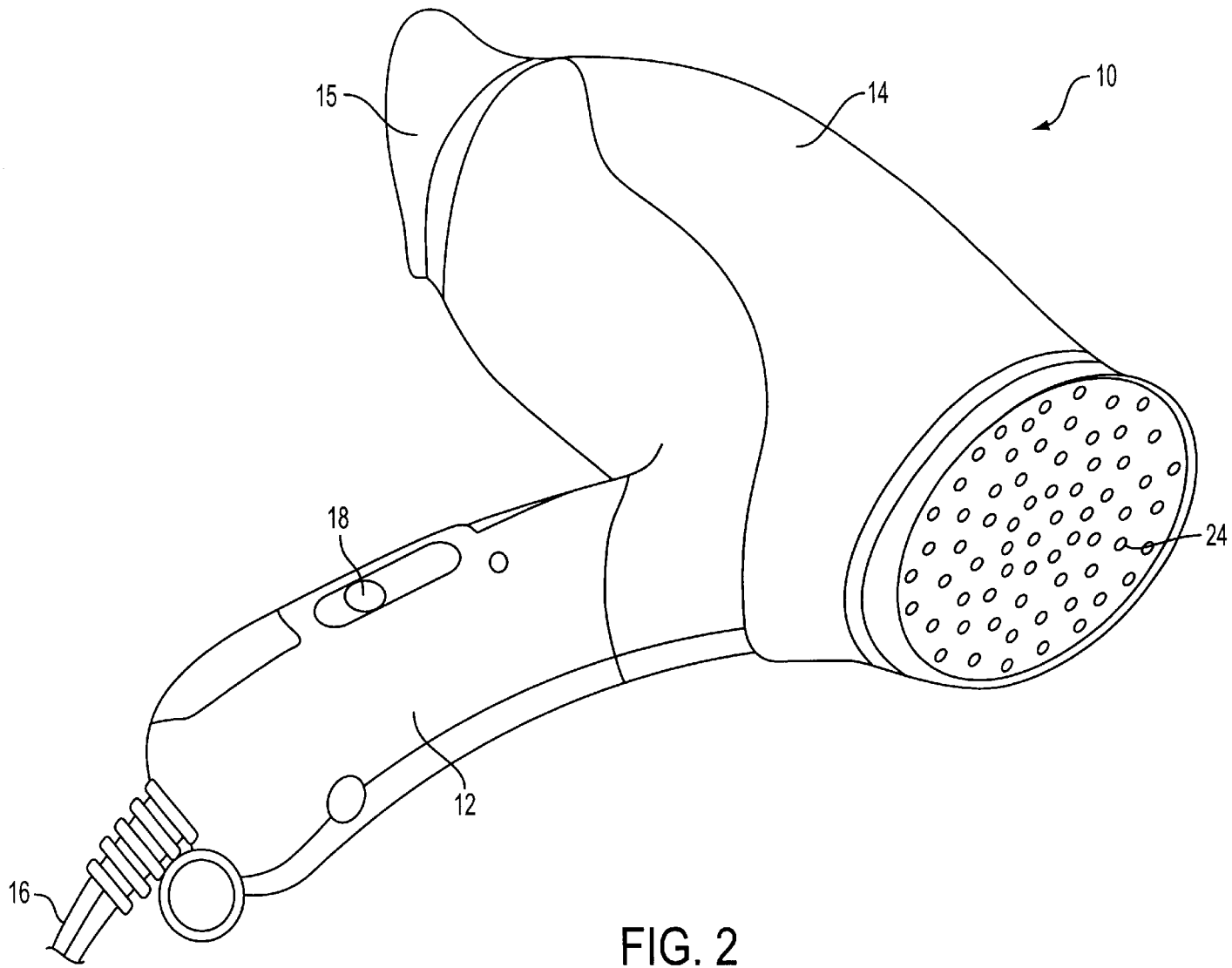
FIG. 2 is a perspective view of the hair dryer of FIG. 1 fitted with a removable nozzle.

As seen in FIG. 2, a removable nozzle 15 can be fitted on the outlet end of the tubular housing 14. A power cord 16 supplies electric power to switch 18 from plug 20, which is typically plugged into a conventional electrical outlet.

Switch 18 distributes electrical power to a high-voltage DC generator 22 which is located within tubular housing 14 between a circular ambient-air inlet 24 and a cylindrical tubular fan housing 26. A motor 28 also receives electrical power from switch 18 to drive fan blade 30. The motor 28 and blade 30 form a fan unit. Air drawn into the tubular housing 14 through inlet 24 by fan blade 30 advantageously flows over generator 22 and thereby cools the generator before entering the fan housing 26.

A heating coil assembly 32 is mounted in tubular housing 14 in front of the fan blade 30 and fan housing 26. A heating coil 34 receives electrical power from switch 18 in a known fashion. An ion-emitting metal pin or electrode 36 is mounted on the front center of the heating coil assembly 32 for producing negative ions in the air 38 which flows past the electrode 36.

Although the electrode 36 functions well when located as shown at the front of the heating coil assembly 32 adjacent air outlet 40, it has been found that the electrode 36 also functions well when located, as shown in dashed lines, between the fan blade 30 and the heating coil 32. Another design alternative is to locate the high voltage generator 22 on the exterior of tubular housing 14 and handle 12 and wrapping and taping its wiring around the power cord 16 and running its wiring through the bottom of handle 14. By locating the voltage generator 22 on the power cord 16, adjacent plug 20, the weight of the generator 22 can be removed from the hand-held hair dryer. This improves the maneuverability of the dryer 10. However, the alternative placement of the voltage generator 22 next to inlet 24 helps to balance the hair dryer 10 in one's hand, so there are benefits to be achieved with either an internal or external mounting of voltage generator 22.

Voltage generator 22 can take the form of a commercially available transformer such as a unit available from FUFONG as model FA1-7-2. This unit receives 120 volts at 50 to 60 Hz and provides a negative DC voltage output of 7 kilovolts. It has been found that 7 KV of negative voltage produces a most satisfactory ionization of the air 38 for the purpose of neutralizing the positive charge on a person's hair during hair drying.

Figure 1:
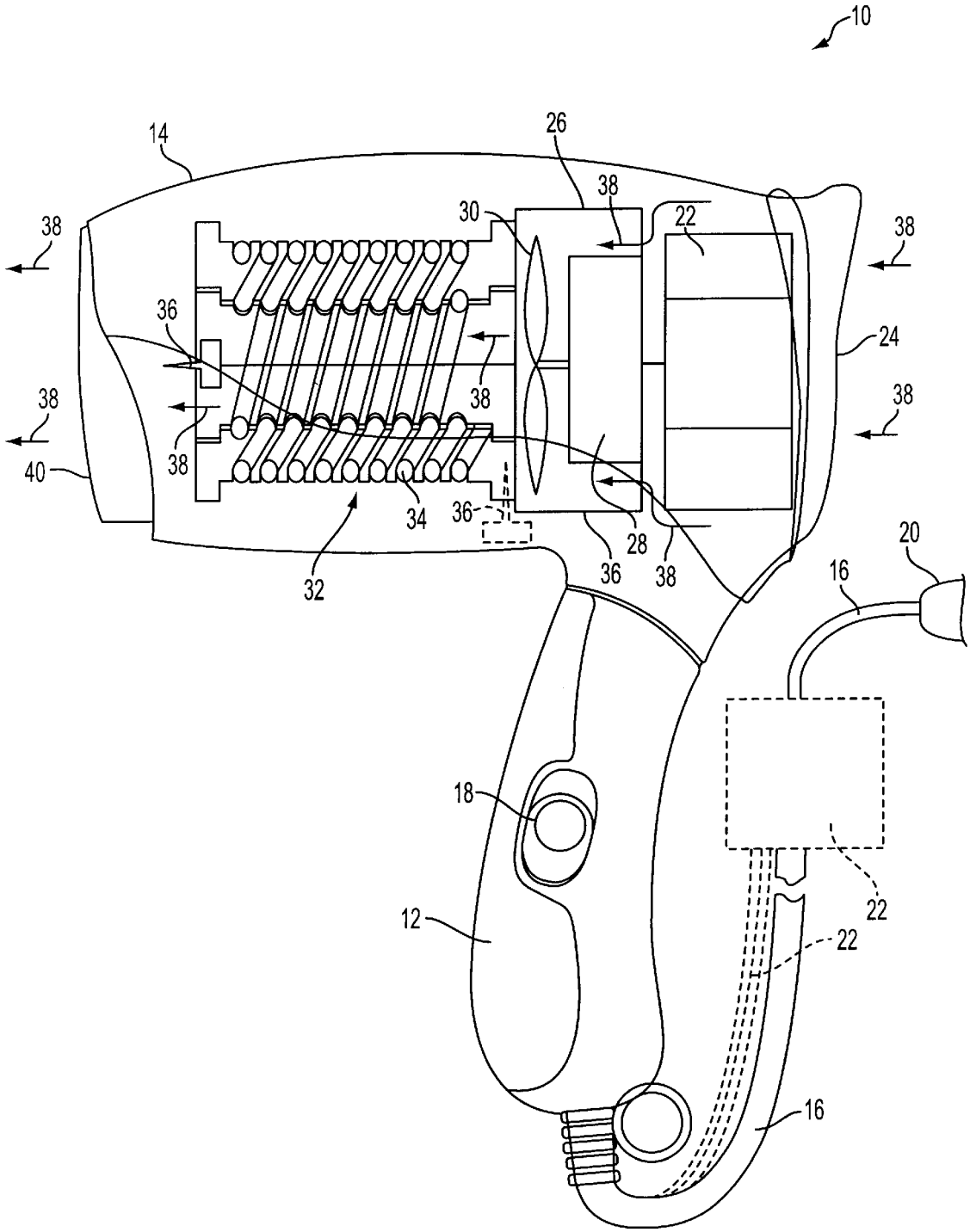
FIG. 1 is a schematic view, partially in section, showing an negative-ion-emitting hair dryer constructed in accordance with a first embodiment of the invention, and showing alternate constructions in dashed lines.

A schematic circuit diagram is shown in FIG. 2 for use with the hair dryer 10 of FIG. 1. Switch 18 is a commercially available three-position switch sold by DEFOND under model number DPW-1211. Switch 18 provides an off condition, and two power settings with one rated at 11 amps at 120 volts AC and the other rated at 6 amps at 250 volts AC. A trigger switch 43 is provided on switch 18 for cycling through the three switch positions.

Figure 3:
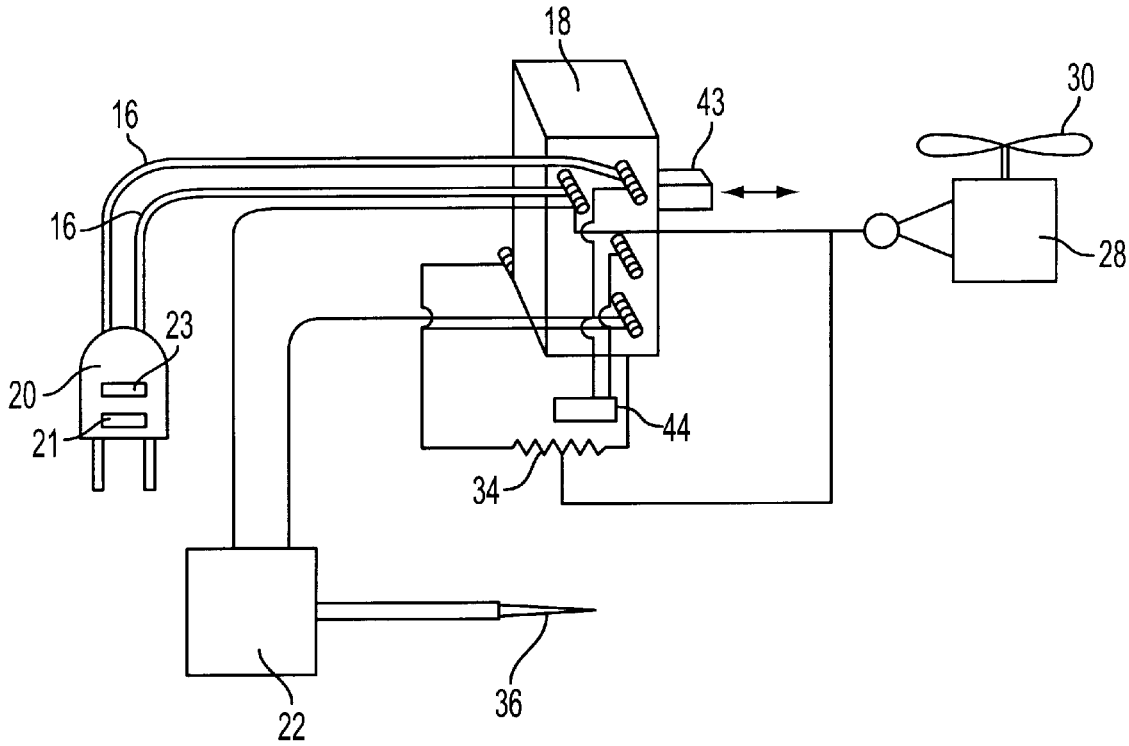
FIG. 3 is a schematic view of a wiring circuit adapted for use with the hair dryer of FIG. 1.

As further seen in FIG. 3, a temperature responsive switch 44 can be mounted next to the heating coil 34 to shut off power to the heating coil if it becomes excessively hot. The plug 20 can include a circuit breaker 21 and reset switch 23 for protecting the hair dryer from overloading on power. Such a plug is available from Tower Switches Ltd. as catalog model No. 303.

When the switch 18 is triggered into its first on position, power is fed to the voltage generator 22, fan motor 28 and heating coil 34. Cool air is drawn into inlet 24, over the voltage generator 22, through the fan housing 26, over the heating coil 34, over the negatively-charged electrode 36 and out of the tubular housing 14 through outlet 40.

Heated negative ions exit outlet 40 and may be directed onto a person's hair to neutralize the typically positively-charged hair. As noted above, brushing and combing one's hair can cause the hair to become positively charged and difficult to style and hold neatly in place. However, when negative ions are applied by hair dryer 10 during such brushing and combing, the positively charged hair is neutralized in charge and becomes much more manageable.

There has been disclosed heretofore the best embodiment of the invention presently contemplated. However, it is to be understood that various changes and modifications may be made thereto without departing from the spirit of the invention.

What is claimed is:

1. A hair dryer, comprising:

a tubular housing having an air inlet and an air outlet;

a high voltage generator mounted within said tubular housing adjacent said air inlet;

a fan unit mounted in said tubular housing between said air outlet and said high voltage generator;

a heating coil assembly mounted in said tubular housing between said air outlet and said fan unit; and a high voltage electrode mounted in said tubular housing and connected to said high voltage generator for producing negative ions, and wherein ambient air is drawn into said tubular housing through said inlet, over said high voltage generator so as to cool said high voltage generator, around said heating coil assembly and out of said tubular housing through said air outlet.

2. The hair dryer of claim 1, wherein said high voltage generator comprises a transformer which produces a negative DC voltage output of at least about 6 kilovolts.

3. The hair dryer of claim 1, wherein said high voltage electrode comprises a metal pin mounted in said tubular housing adjacent said air outlet.

4. The hair dryer of claim 1, wherein said high voltage electrode comprises a metal pin mounted in said tubular housing between said fan unit and said heating coil assembly.

5. A hair dryer, comprising:

a tubular housing having an air inlet and an air outlet;

a handle connected to said tubular housing;

a heating coil assembly mounted in said tubular housing between said air inlet and said air outlet;

a high voltage electrode mounted within said tubular housing;

a fan unit mounted in said tubular housing between said air inlet and said heating coil assembly; and a high voltage generator mounted externally of said tubular housing and said handle.

6. The hair dryer of claim 5, further comprising a power cord connected to said handle, and wherein said high voltage generator is connected to said power cord externally of said handle.

7. The hair dryer of claim 5, wherein said high voltage generator comprises a transformer which produces a negative DC voltage output of at least about 6 kilovolts.

8. The hair dryer of claim 5, wherein said high voltage electrode comprises a metal pin mounted in said tubular housing adjacent said air outlet.

9. The hair dryer of claim 5, wherein said high voltage electrode comprises a metal pin mounted in said tubular housing between said fan unit and said heating coil assembly.

10. A hair dryer, comprising:

a tubular housing having an air inlet and an air outlet;

a handle connected to said tubular housing;

a fan unit mounted in said tubular housing;

a heating coil assembly mounted in said tubular housing adjacent said fan unit;

a high voltage electrode mounted in said tubular housing for producing negative ions; and a high voltage generator electrically connected to said high voltage electrode, said high voltage generator having an input of 120 volts AC at 50 to 60 Hertz and having a negative DC voltage output of at least about 6 kilovolts.

11. The hair dryer of claim 10, wherein said high voltage generator is mounted in said tubular housing between said air inlet and said fan unit.

12. The hair dryer of claim 10, wherein said high voltage electrode is mounted between said fan unit and said heating coil assembly.

* * * * *